United States Patent [19]

MacLeod

[11] Patent Number: 4,820,137

[45] Date of Patent: Apr. 11, 1989

[54] WELL PUMP

[76] Inventor: Donald I. G. MacLeod, 46 Waitara Crescent, Greenwood 6024, Australia

[21] Appl. No.: 124,777

[22] PCT Filed: Dec. 9, 1986

[86] PCT No.: PCT/AU86/00376

§ 371 Date: Aug. 10, 1987

§ 102(e) Date: Aug. 10, 1987

[87] PCT Pub. No.: WO87/03649

PCT Pub. Date: Jun. 18, 1987

[30] Foreign Application Priority Data

Dec. 11, 1985 [AU] Australia ..... PH03826

[51] Int. Cl.[4] ..... F04B 39/10; F04B 21/00

[52] U.S. Cl. ..... 417/566; 137/533.27

[58] Field of Search ..... 417/566; 137/533.27

[56] References Cited

U.S. PATENT DOCUMENTS

| | | | |
|---|---|---|---|
| 345,657 | 7/1886 | Wylie | 417/566 |
| 555,096 | 2/1896 | Hooker | 417/566 |
| 2,628,563 | 2/1953 | Coberly | 417/566 |
| 2,743,677 | 5/1956 | Fleming | 133/533.27 |
| 2,765,742 | 10/1956 | King | 417/566 |
| 2,902,049 | 9/1959 | Ilfrey | 417/566 |
| 4,375,946 | 3/1983 | Page | 417/566 |

*Primary Examiner*—William L. Freeh

*Attorney, Agent, or Firm*—Pearne, Gordon, McCoy & Granger

[57] ABSTRACT

A submersible well pump of the barrel and piston type characterized by a valve chamber formed coextensively with the barrel and containing an inlet valve and an outlet valves arranged to admit fluid to one end of the barrel on a first stroke of an unported piston and to discharge the fluid from the same end of the barrel on a second opposite stroke of the piston. A double acting version of the pump is also disclosed.

5 Claims, 2 Drawing Sheets

WELL PUMP

This invention relates to a well pump and in particular it relates to a pump of the type which is positioned in a well at the end of a string of delivery pipes which convey liquid pumped from the well to an elevated position, in which the pump is actuated by a plunger rod passing up the string of pipes.

It is customary in pumps of this kind to have a barrel which has in it a piston reciprocated by the plunger rod actuated from a windmill or other driving means and to have in the base of the barrel a foot valve which allows liquid to enter the barrel at the appropriate time, and to have within the piston a valve which allows liquid to move upwardly through the piston but not down, so that as the piston is reciprocated, liquid is lifted by the piston on the upstroke with the piston valve closed and the foot valve open, but on the downstroke the piston moves freely through the liquid with the piston valve open and the foot valve closed so that the space above the piston is then filled with liquid for the next lift.

According to an earlier invention of mine, the pumping was achieved by a balance system using fluids to actuate the piston in the pump cylinder, but the present invention is directed to a mechanically actuated pump of the general type described earlier herein.

The object of the present invention is to provide certain improvements to pumps of this type, the object being achieved according to this invention by utilizing a barrel in which a piston is reciprocated by means of a plunger rod, but the piston itself is not provided with valve means but has buckets arranged to prevent the passage of liquid or fluids past the piston, the valve mechanism being situated in an extension at the top of the barrel in which the piston moves, the valves being situated in this extension.

The invention thus comprises a submersible well pump of the barrel and piston type characterised by a valve chamber formed coextensively with the barrel and containing at least an inlet valve and an outlet valve arranged to admit fluid to one end of the barrel on a first stroke of the piston and to discharge the fluid from the same end of the barrel on a second opposite stroke of the piston.

In its preferred form the invention comprises a pump having a barrel adapted to be supported by a delivery type and adapted to be submerged in the fluid to be pumped and comprising a barrel having a piston within it adapted to be coupled by a plunger rod to a reciprocating mechanism and including inlet and outlet flow control valves, characterised in that the flow control valves are positioned in an extension of the barrel coextensive with the barrel and arranged on a first stroke in one direction to cause a flow of fluid into the barrel through the inlet valve to the retreating side of the piston and, at a second stroke in the opposite direction to discharge the fluid from the barrel through the outlet valve to the delivery pipe.

The invention also has reference to a double-acting pump.

To enable the invention to be fully understood embodiments thereof will now be described with reference to the accompanying drawings in which:

FIG. 7 is a longitudinal sectional view of a second embodiment showing a double-acting arrangement.

Figure 1:
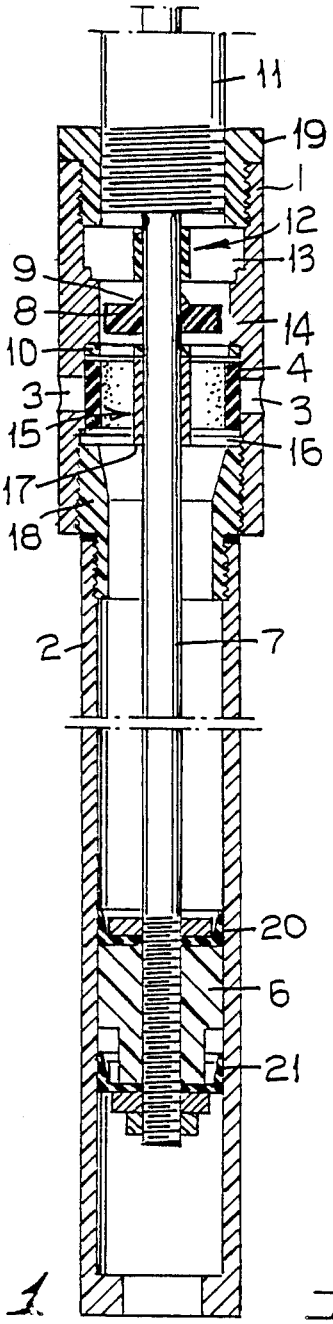
FIG. 1 is a longitudinal sectional view of first embodiment of the invention.
Figure 2:
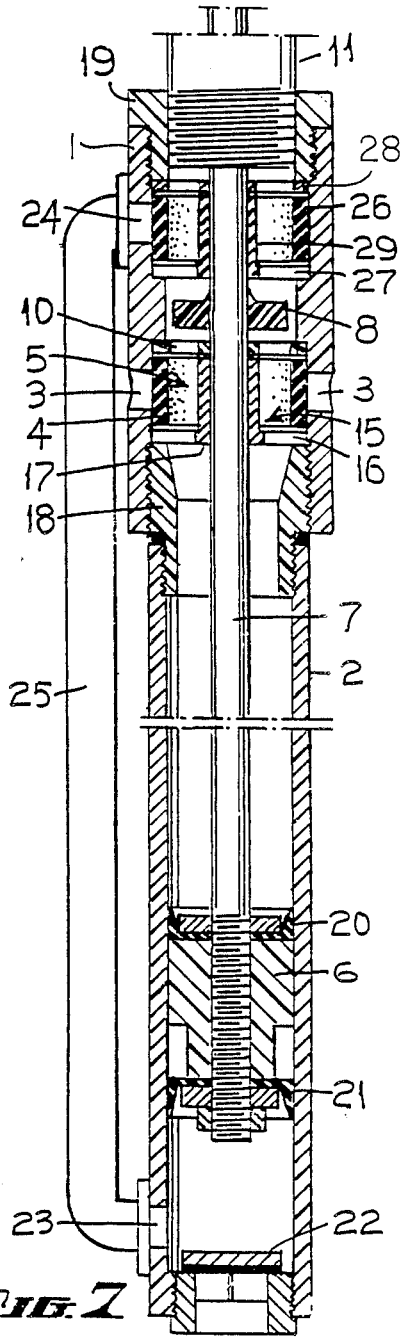
FIG. 2 is an enlarged longitudinal sectional view of the valve extension.
Figure 3:
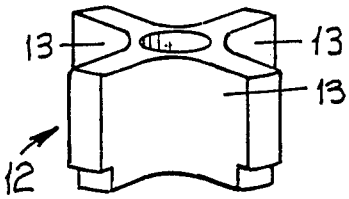
FIGS. 3, 4, 5 and 6 are components of the valve mechanism.
Figure 4:
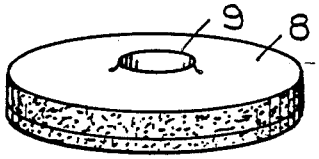
Figure 5:
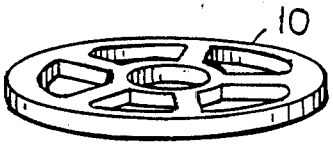
Figure 6:
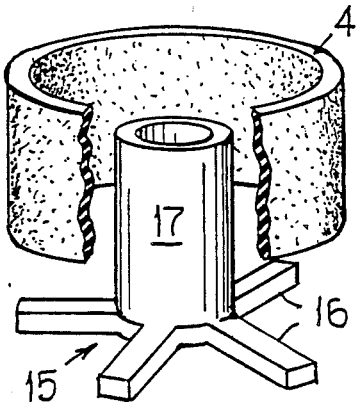
Figure 2:
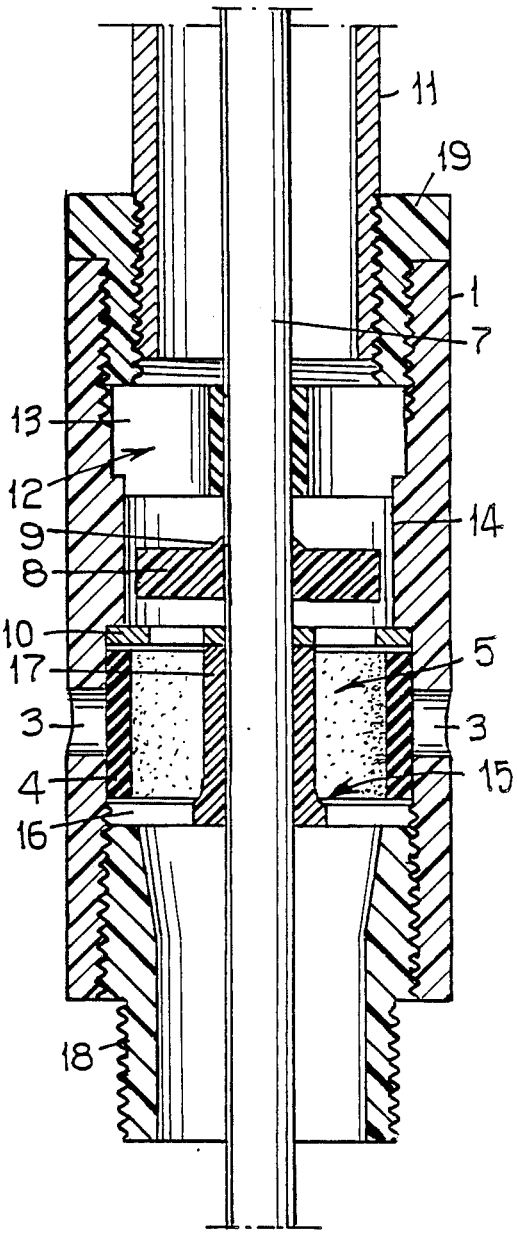

Describing first the form illustrated in FIGS. 1 to 6 inclusive, the extension 1 screws to the top of a barrel 2 to be coextensive therewith and this extension 1 has in it intake ports 3 which terminate in which I term a garter-type reed valve 4, that is a valve which is expanded in a chamber 5 in the extension to engage the inner face of the extension over the intake ports 3. This prevents outflow of fluid but allows fluid flow into the chamber 5 when the reed valve 4 contracts into the chamber 5 due to fluid being drawn into the hollow by the piston 6. The fluid flows through the intake port 3 and around the reed valve 4 into the chamber 5 and thence into the barrel 2 of the pump. This reed valve 4 is the fluid inlet valve to the barrel 2.

By this arrangement the pump barrel 2 is filled from the top end when the piston 6 is on the down-stroke, the piston aiding inflow of the liquid to the barrel 2 as it is downwardly displaced.

Within the extension 1, situated in the chamber 5 surrounding the plunger rod 7 is a non-return disc valve 8 having rod seal 9, which valve is adapted to seat downwardly onto a webbed valve seat 10 also surrounding the plunger rod 7. This is the outlet valve from the barrel 2.

The arrangement of this non-return valve 8 is such that on the upstroke of the piston 6, when the reed valve 4 is forced outwardly to close off the intake ports 3, liquid flows upward through the ported valve seat 10 and past the non-return valve 8 which it lifts to allow free flow past it and up the delivery pipe 11 which in turn is secured to the top of the extension 1.

This non-return valve 8 frictionally engages the plunger rod 7 through the rod seal 9 so that when the plunger rod 7 moves downwardly it moves with it until the ported valve seat 10 is engaged to seal downward flow, and at that stage the delivery pipe 11 holds the liquid within it as it cannot return to the barrel 2.

The non-return valve rod seal 9 is pressed against the plunger rod so that when this non-return valve 8 is seated on the ported valve seat 10, no fluid can flow past the non-return valve 8. Situated above the non-return valve 8 is a ported rod guide 12 through the ports 13 of which the liquid flows into the delivery pipe, but this rod guide 12 correctly guides the plunger rod to retain its axial position in relation to the chamber 5 in the extension 1.

Assembly of the valves in the extension 1 is by inserting the ported valve seat 10 upwards into the chamber 5 from the barrel end and holding it against a step 14 in the chamber 5 in the extension 1 by means of a flow-through holding member 15 which comprises a spider 16 with a hollow stem 17 which encircles the plunger rod 7, and retaining this by a threaded ferrule 18 which is part of or engages the barrel 2.

In this way a cage is formed, consisting of a spider 16 and the ported valve seat 10, in which the reed valve 4 is axially confined. The reed valve 4 is however able to flex to allow fluid to be drawn inward to the chamber 5 by action of the piston 6 or by fluid pressure.

The non-return valve 8 is confined in a flow-through cage formed by the webbed valve seat 10 and the ported rod guide 12, and the ported rod guide is inserted from above and is held against the stop 14 by a socket 19 which engages the delivery pipe 11.

The piston 6 is provided with a pair of buckets 20 and 21 which are positioned to prevent flow past the piston 6 during its lifting stroke. The lower bucket 21 can however be reversed if greater suction is required on the downstroke of the piston 6 to draw fluid through the ports 3 and past the reed valve 4.

The above described embodiment results in a single acting pump which delivers liquid on the upstroke but draws liquid into the barrel on the downstroke.

According to a modification of the invention as shown in FIG. 7, in which similar reference numerals for components similar to those referred to with reference to the first described embodiments are used.

This is generally similar in construction to the form first described but has a foot valve 22 positioned in the barrel 2 so that on the upstroke of the piston 6, fluid can be drawn into the lower part of the barrel 2. A port 23 in the lower part of the barrel 2 is connected to a port 24 in the upper port of the extension 1 above the ported rod guide 12 by a transfer pipe 25, which allows fluid on the downstroke of the piston 6, when the foot valve 22 and the non-return valve 8 are closed, to flow upwardly through the transfer pipe 25 into the delivery pipe 11 so that, on the downstroke, the fluid below the piston 6 is displaced into the transfer pipe 25 and hence into the delivery pipe 11 which takes the fluid to the surface.

The port 24, which communicates with the transfer pipe 25, is in turn provided with a second non-return valve 26, which is in the form of another garter-type reed valve at the upper part of the extension 1, although a flap valve could be used. This garter-type reed valve 26 is positioned in the upper part of the chamber 5 above a ported disc 27 to normally close the port 24 when the reed valve 26 is pressed against the wall of the chamber in which it is housed to prevent back flow down the transfer pipe 25 from the delivery pipe 11 which leads to the surface.

The second reed valve 26 can be inserted from above and held in a cage formed between a spider 27 and a ported disc 28 which is engaged by the socket 19, the spider having a hollow stem 29 projecting upwards to space the ported disc 28 at the correct distance from the spider 27.

From the foregoing it will be realised that a simple and effective pump is provided which can be readily assembled and which comprises a barrel as a lower integer of the pump with an extension at the top which carries all the valve means excepting the foot valve in the case where the pump is to be double acting.

It will also be appreciated that a pump is formed having an extension 1 on one side of the barrel 2 which is coextensive with the barrel 2 and houses at least an inlet valve 4 and an outlet valve 8 in flow-through cages in the chamber 5 formed in the extension 1, and that the pump can readily be converted to be double acting by simply adding a foot valve 22 and a second inlet valve 26.

The valves 4 and 8 and 26 can be located by means other than the flow-through cages, but the form illustrated allows the valves to be located by positioning at least one from each end of the chamber and locking the structure together by end members such as the barrel 2 and the socket 19.

To enable the string of delivery pipes and pump to be withdrawn readily for servicing or the like a small valve may be included at the top of the pump which is normally closed, but can be opened by pull on a line leading to the surface to allow the water from the delivery pipe to flow out of the pipe to thereby lighten the load when withdrawing the pipe, but such a release is not illustrated but can be readily applied by persons versed in the art.

I claim:

1. A well pump comprising a barrel adapted to be supported by a delivery pipe and arranged to be submerged in a fluid to be pumped, a piston within the barrel adapted to be coupled by a plunger rod to a reciprocating mechanism and including inlet and outlet flow control valves positioned to surround the said plunger rod in an extension at the delivery end of the barrel and coextensive therewith, said pump being arranged in a first stroke of the piston in one direction to cause a flow of fluid through the inlet valve into the barrel on the retreating side of the piston and in a second stroke in the opposite direction to discharge the fluid from the advancing side of said piston in the barrel through the outlet valve to the delivery pipe, said inlet valve being a reed valve positioned in a chamber in the extension over fluid inlet ports through the wall of the extension, said extension having a step inwardly extending into said chamber, and a webbed seat for the outlet valve urged against one side of the step by a flow-through holding member to form a flow-through cage for the reed valve.

2. A well pump according to claim 1, wherein a ported plunger rod guide in the chamber of the extension is confined against the other side of the step to form a flow-through cage for the outlet valve between the ported valve seat and the ported plunger rod guide.

3. A well pump according to claim 1, wherein the extension is removable and communicates at an upper end with the delivery pipe and at a lower end with the barrel, the plunger rod passes axially through the chamber, the flow control valves are positioned in the chamber, and said outlet valve is a disc valve seated on said webbed seat and extending across the chamber and around the plunger rod.

4. A well pump according to claim 1, including a foot valve at the end of the barrel opposite the extension, and a fluid transfer pipe between a first foot port at the foot valve end of the barrel and a second foot port opening through the wall of the extension into the chamber, said second foot port opening into said chamber through a second outlet valve also in the said chamber above the first said outlet valve, the second outlet valve being a reed valve positioned over the second foot port and confined in a second flow-through cage in said extension.

5. A well pump comprising a barrel adapted to be supported by a delivery pipe and arranged to be submerged in a fluid to be pumped, an extension for connecting the barrel to the delivery pipe, a plunger rod extending through the extension for coupling a piston within the barrel to a reciprocating mechanism, inlet and outlet flow control valves positioned in said extension to surround said plunger rod, said pump being arranged in a first stroke of the piston in one direction to cause a flow of fluid through the inlet valve into the barrel on the retreating side of the piston and in a second stroke in the opposite direction to discharge the fluid from the advancing side of said piston in the barrel through the outlet valve to the delivery pipe, said extension including a wall providing a chamber and fluid inlet ports extending through the wall to the chamber, said inlet valve being a reed valve positioned in the chamber over the fluid inlet ports, said extension wall also including a step extending inwardly into said chamber for engaging a webbed seat for said outlet valve, and a flow-through holding member arranged to urge said webbed seat against said step and to cooperate therewith to provide a flow-through cage for the reed valve.

* * * * *